US006622880B1

(12) United States Patent
Di Stasio

(10) Patent No.: US 6,622,880 B1
(45) Date of Patent: Sep. 23, 2003

(54) FOAM INSERT FOR PRESSURE VESSELS

(75) Inventor: Anthony A. Di Stasio, Basking Ridge, NJ (US)

(73) Assignee: Crest Foam Industries, Moonachie, NJ (US)

( * ) Notice: Subject to any disclaimer, the term of this patent is extended or adjusted under 35 U.S.C. 154(b) by 0 days.

(21) Appl. No.: 10/336,863

(22) Filed: Jan. 6, 2003

(51) Int. Cl.[7] ..... B65D 51/16
(52) U.S. Cl. ..... 220/88.1; 220/902; 220/89.1
(58) Field of Search ..... 220/88.1, 503, 220/89.1, 902

(56) References Cited

U.S. PATENT DOCUMENTS 4,248,342 A * 2/1981 King et al.
4,927,045 A * 5/1990 Lichka
5,035,182 A * 7/1991 Purcell et al.
5,285,916 A 2/1994 Ross
5,697,990 A * 12/1997 Shakley et al.

* cited by examiner

*Primary Examiner*—Joseph M. Moy
(74) *Attorney, Agent, or Firm*—John H. Thomas, P.C.

(57) ABSTRACT

A foam insert is adapted for use in combination with a pressure vessel. The cylinder is made of an open cell foam and is sized to fit within the pressure vessel. The cylinder has a top portion and a bottom portion that correspond to a top and bottom of the pressure vessel. The top portion of the foam cylinder has a concave recess.

11 Claims, 6 Drawing Sheets

FOAM INSERT FOR PRESSURE VESSELS

The field of the invention is pressure vessels used to contain gas under pressure. More specifically, the invention relates to a foam insert for use in connection with pressure vessels to reduce likelihood of flare out when gas contained in the vessel is a flammable material.

BACKGROUND OF THE INVENTION

It is known that the use of open cell foam inserted into a pressure vessel may reduce the likelihood of dangerous flare out when the pressure vessel carries flammable material. U.S. Pat. No. 5,285,916 to Ross describes the benefits and safety advantages resulting from the use of a foam insert. The Ross patent further sets forth in detail the state of the art at that time of various pressure vessel products.

In the actual assembly and filling of pressure vessels, it has been learned that the foam insert may cause problems. The foam insert can block the easy insertion and mounting of a valve mechanism onto a pressure vessel. Depending on the size of a given valve, and specifically its stem component, and the amount of the foam insert, the foam may abut the stem and block or make difficult the mounting of the valve onto a container having a foam insert. The foam cylinder may also interfere with the proper sealing of the valve to the can.

SUMMARY OF THE INVENTION

Accordingly, it is an object of the present invention to provide a foam insert that overcomes the assembly and filling problems noted earlier. The foam insert incorporates a recess that is adapted to receive the inside components of a valve assembly that is mounted onto a pressure vessel.

In one embodiment, a foam insert is adapted for use in combination with a pressure vessel. The insert comprises a cylinder comprised of an open cell foam, the cylinder sized to fit within the pressure vessel. The cylinder comprises a top portion and a bottom portion that correspond to a top and bottom of the pressure vessel. The top portion of the cylinder comprises a concave recess. Additionally, the bottom portion of the cylinder may comprise a concave recess. The recess may extend across the width of the top of the cylinder. The recess may have a v-shaped cross section or a u-shaped cross section or be a blind hole. The foam may be a reticulated open-cell foam. The foam may be flexible. The foam may have a rectangular shape. The pressure vessel may be an aerosol can. The depth of the recess in the insert is in the range of about ¼ inch to 1 inch depending on valve housing length, preferably about ¾ of an inch for a typical valve housing.

DETAILED DESCRIPTION

A specifically shaped foam insert allows for easy assembly of a pressure vessel and still provides the safety attributes of the foam in the vessel. Any foam insert adapted to substantially fill the volume of a particular pressure vessel can be modified to facilitate assembly of the final container. In simple terms, a concave recess is cut out, drilled out, removed or molded out of the portion of the insert at the top of the vessel. The recess enables proper mounting of a valve mechanism on top of the vessel. The size of the recess can be varied to provide space for any size valve mechanism and any specific valve stem that extends inwardly inside the vessel.

Figure 1:
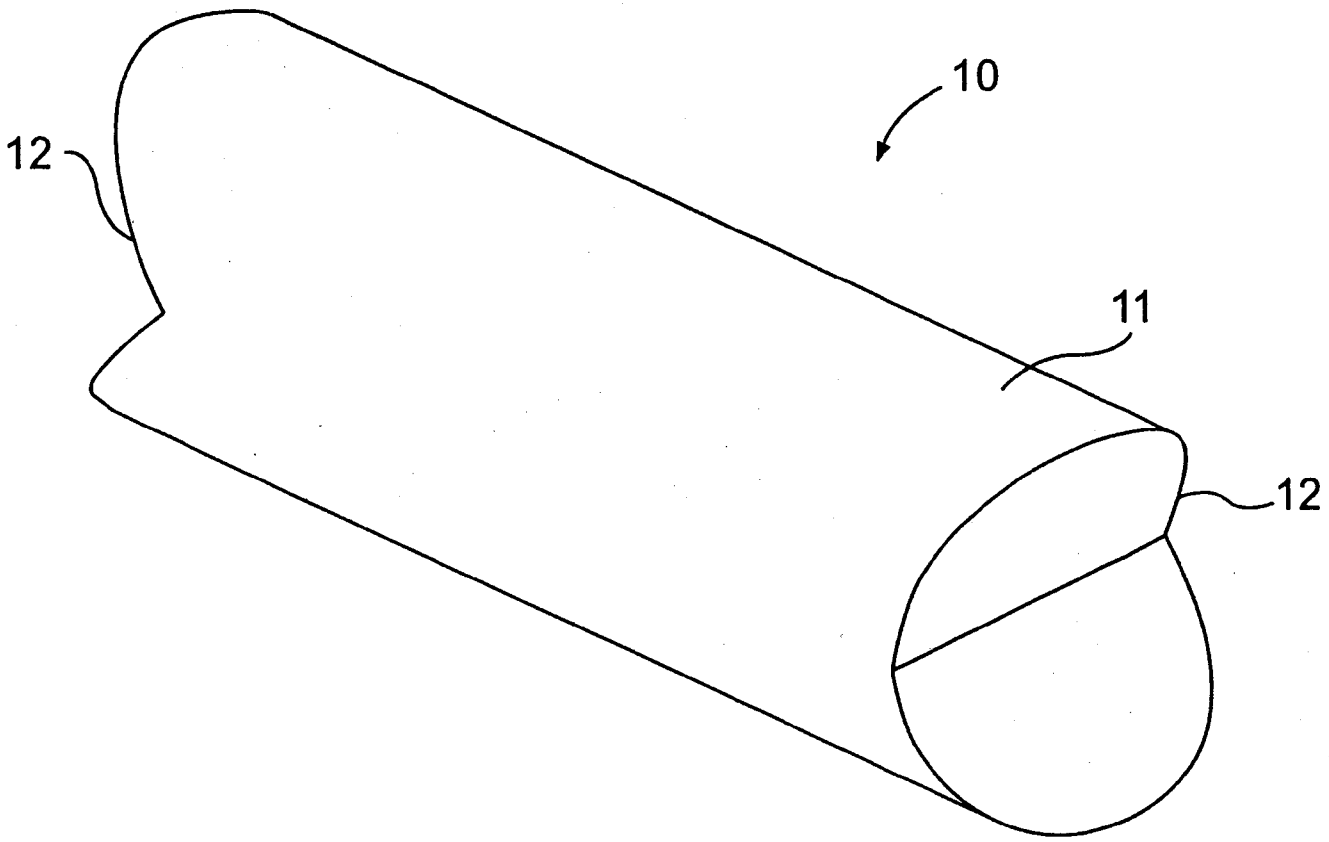
FIG. 1 is a perspective view of a foam insert in accordance with the present invention.
Figure 2:
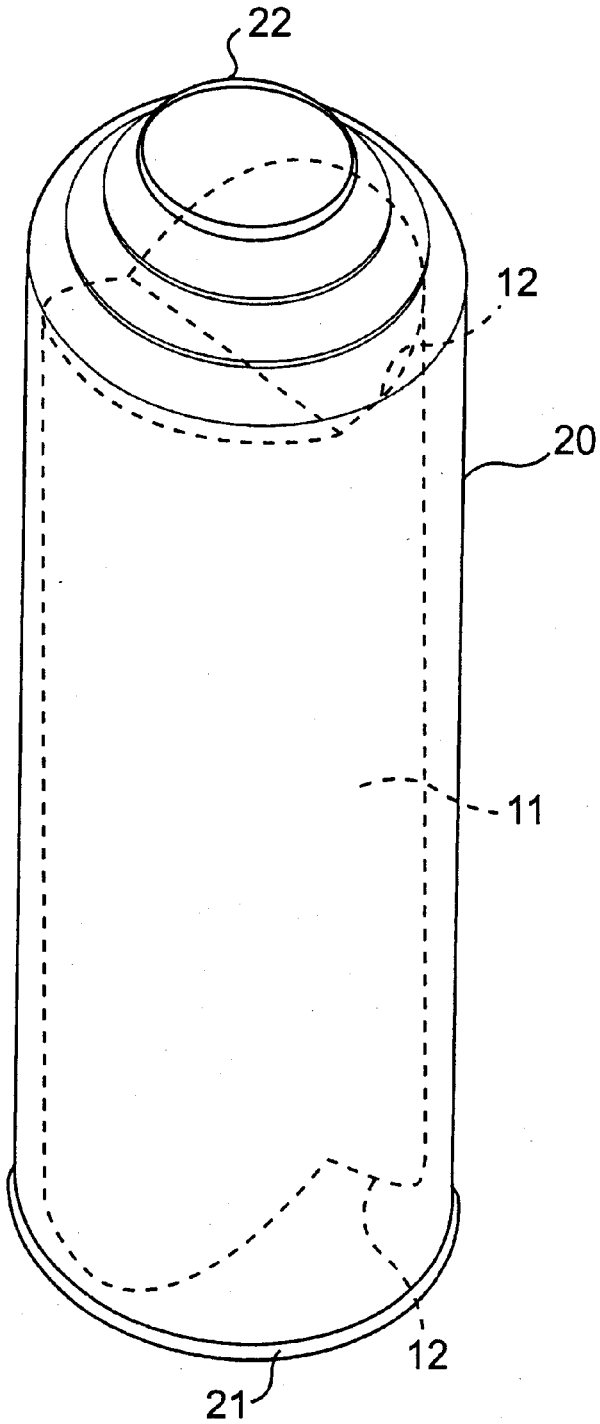
FIG. 2 is a perspective view of an aerosol can that has a foam insert mounted within it.
Figure 3:
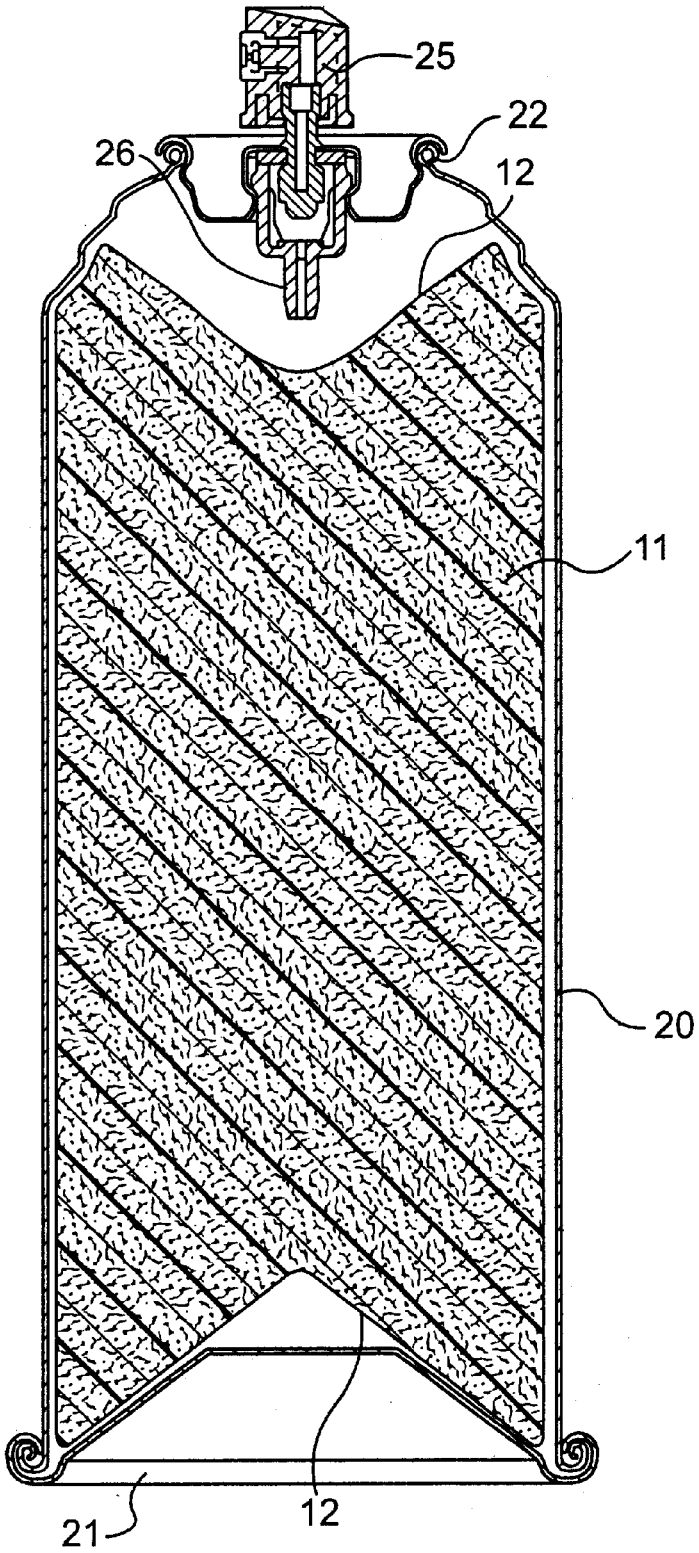
FIG. 3 is a side elevation, cross section of an aerosol can having a foam insert in it and further including a spray valve mechanism mounted in it.

FIGS. 1–3 illustrate a foam insert 10 that is adapted to be inserted into a pressure vessel (aerosol can 20). The insert 10 is made of an open cell foam body 11 having v-shaped, concave recesses 12 cut out of the top and bottom of the insert. As shown, the recesses 12 extend across the width of the top of the body 11 of the insert 10. As shown in FIG. 1, the body 11 has a round cylindrical shape. The pressure vessel shown in FIGS. 2 and 3 is an aerosol can 20 having a bottom 21 and a top aperture 22. The aperture 22 is the hole into which the valve mechanism 25 is mounted. The valve housing 26 extends inwardly into the vessel from the top of the can 20. The recess 12 is of an appropriate size that the housing 26 does not abut or otherwise press into the foam insert 11. And the foam does not interfere with the proper sealing of the valve to the can.

The pressure vessel that may be used in connection with the present invention may be any type of container that assumes any shape. It may be an aerosol or non-aerosol can. In a preferred embodiment, a container such as can 20 is used to store flammable gases such as butane or propane. One specifically preferred type of can is referred to as an A-24 can from Sexton Can Company, Inc. The Sexton can is described in detail in U.S. Pat. No. 5,285,916. The '916 patent is incorporated by reference in this application as if set forth in its entirety.

The foam that makes up the body 11 of the insert may be any kind of open-cell foam. It can be rigid; semi-rigid or flexible. Preferably the foam contains pores in the range of about 10 to about 100 pores per square inch. More preferably, the foam has about 30 pores per square inch. A reticulated polyurethane foam has been found to be effective. Specifically, a polyether reticulated urethane foam is used in a preferred embodiment with the A-24 can. Of course, polyester and other types of open cell foams and mixtures thereof could be acceptable. The density of the foam is preferably in the range of about 0.1 to 10 lbs per cubic foot. More preferably, the density of foam is about 1.2 lbs per cubic foot.

Figure 4:
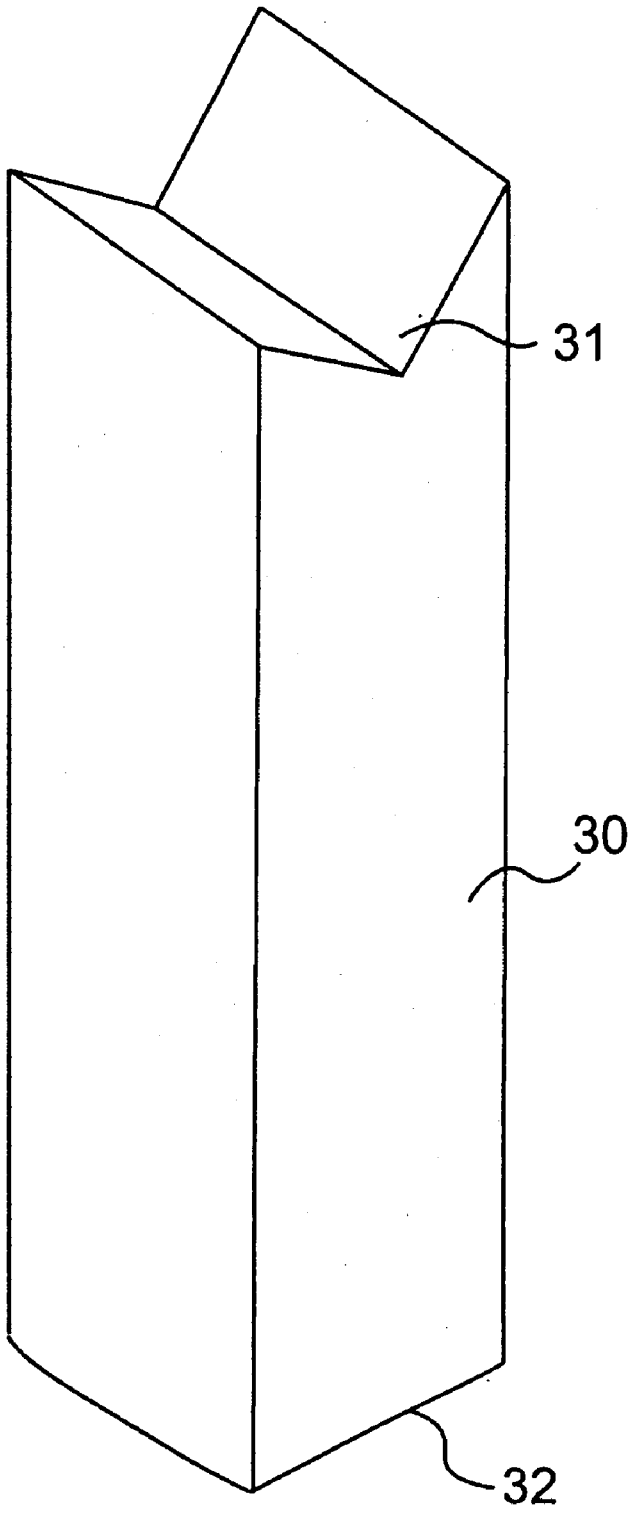
FIGS. 4–6 are perspective views of alternative embodiments of foam inserts in accordance with the present invention.
Figure 5:
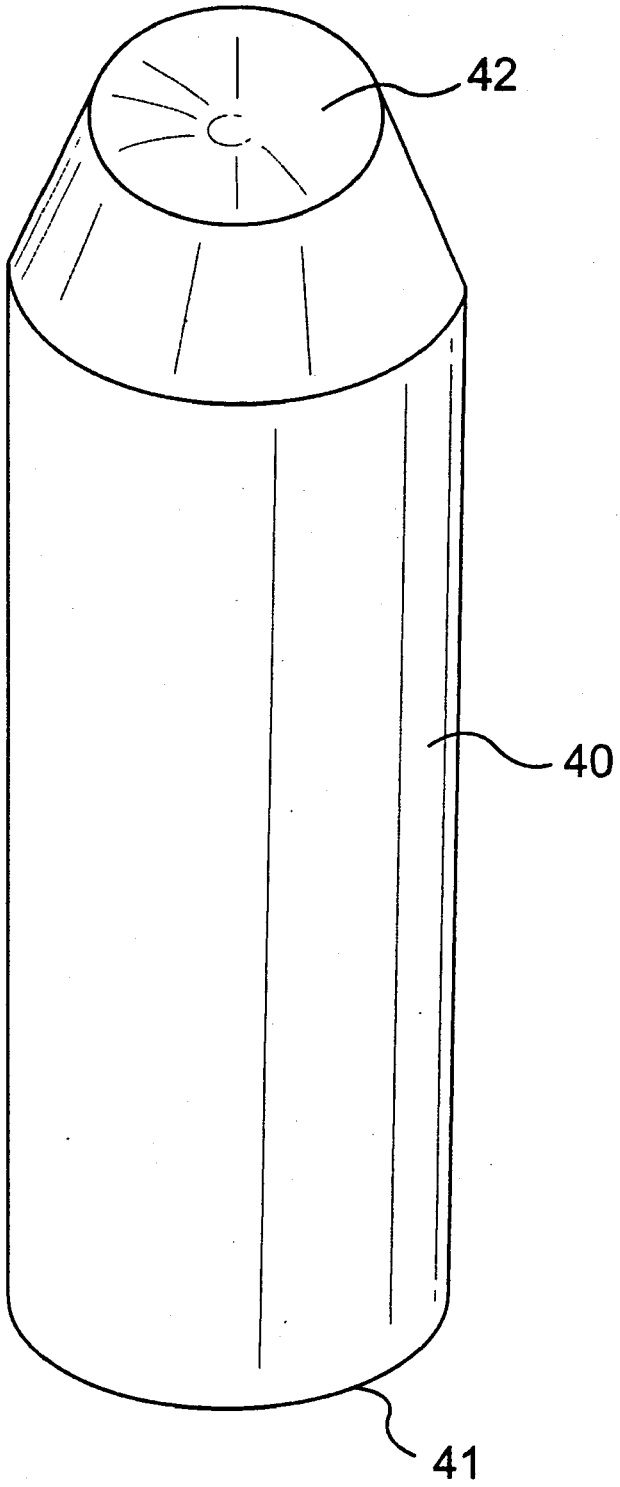
Figure 6:
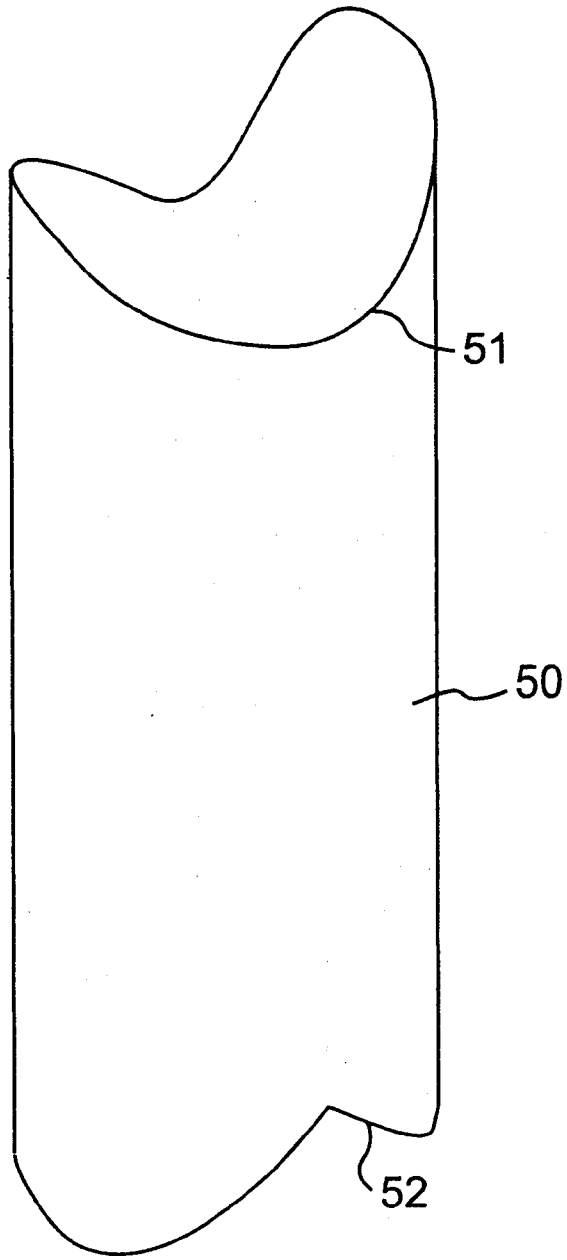

The shape of the foam insert may vary depending on the shape of the pressure vessel or container that is to be used. FIGS. 4, 5 and 6 illustrate other alternative embodiments of the shape of a foam insert. As shown in FIG. 1, the round cylindrical shape of the foam insert 10 can exactly fit the round cylindrical shape of the can into which it is inserted. It is alternatively possible that the cylindrical shape of the insert may be rectangular as shown in FIG. 4 or bullet-shaped as shown in FIG. 5. The cylindrical shape may also be pentagonal, hexagonal or octagonal in cross-section. Regardless of the shape, the top of the foam insert, that corresponds to the top of the pressure vessel, must have a concave recess to accommodate the housing of the valve mechanism that will be used. The recess may be v-cut, a u-cut, a scoop-out, or any other shaped absence of foam material. Similarly, the recess shape may be hemispherical (FIG. 6) or conical or rectangular. The recess may be a blind hole.

In the example of the A-24 can and its standard valve assembly, it is preferred that the recess have a ¾ inch depth—that is, ¾ of an inch from the finished height of the cylindrical insert 11. Also, again specifically with respect to the use of the A-24 can, the height of the insert is 7⅛ inches and the diameter is 2½ inches. By using a flexible foam, the insert 11 can be temporarily compressed during assembly and placed within the can 20 through the top 22 of the can. Once inserted, the foam insert 11 will naturally expand to fill most of the space within the can 20 except for the recess. Also, although not practical commercially, the foam insert 11 can be placed within can 20 before the bottom 21 is attached. The recess 12 is placed adjacent the top 22 of the can.

FIG. 4 illustrates a rectangular cylindrical insert. This insert may be used in a rectangular-shaped can. Alternatively, it may also be inserted in a round, cylindrical can like the A-24 can shown in FIG. 2. The insert 30 in FIG. 4 has a v-shaped recess 31 cut out of the top of the insert. The bottom of the insert 32 is flat. As evidenced by this drawing, the shape of the bottom of the insert does not necessarily include a recess.

FIG. 5 illustrates a bullet-shaped insert 40. The bottom of the insert 41 is flat. The recess 42 is scooped out of the top of the insert 40. The scooped out recess 42 is roughly in the shape of a hemisphere.

FIG. 6 demonstrates a round cylindrical insert 50 having a v-cut shaped recess 52 on the bottom of the insert and u-shaped cut recess 51 at the top of the insert. This alternative embodiment exemplifies that the recesses on the top and/or bottom of the foam insert may be same or they may be different.

The material that is actually injected and stored in the pressure vessel container may also affect the foam insert and its shape. For instance, the insertion of propane or butane under pressure will cause the polyether reticulated urethane foam used in a preferred embodiment to expand. In this way, the foam effectively fills the complete interior of the can. Also, the expansion of the foam is not a concern with respect to the valve stem, because the contents are inserted after the valve stem is attached to the top of the can.

While the invention has been described with reference to specific embodiments thereof, it will be understood that numerous variations, modifications and additional embodiments are possible, and all such variations, modifications, and embodiments are to be regarded as being within the spirit and scope of the invention.

What is claimed is:

1. A foam insert adapted for use in combination with a pressure vessel, the insert comprising:

a cylinder comprised of an open cell foam, the cylinder sized to fit within the pressure vessel;

wherein the cylinder comprises a top portion and a bottom portion that correspond to a top and bottom of the pressure vessel;

and further wherein the top portion of the cylinder comprises a concave recess.

2. A foam insert as described in claim 1, wherein the bottom portion of the cylinder also comprises a concave recess.

3. A foam insert as described in claim 1, wherein the recess extends across the width of the top of the cylinder.

4. A foam insert as described in claim 3, wherein the recess has a v-shaped cross-section.

5. A foam insert as described in claim 3, wherein the recess has a u-shaped cross-section.

6. A foam insert as described in claim 1, wherein the foam is a reticulated open-cell foam.

7. A foam insert as described in claim 1, wherein the foam is flexible.

8. A foam insert as described in claim 1, wherein the foam is rectangular-shaped.

9. A foam insert as described in claim 1, wherein the pressure vessel is an aerosol can.

10. A foam insert as described in claim 1, wherein the depth of the recess is in the range of about ¼ inch to 1 inch.

11. A foam insert as described in claim 10, wherein the depth of the recess is about ¾ inch.

* * * * *